United States Patent [19]

Sato et al.

[11] 4,169,673

[45] Oct. 2, 1979

[54] IMAGE TRANSFER DEVICE

[75] Inventors: Yasushi Sato, Kawasaki; Tsutomu Toyono, Ohizumi, both of Japan

[73] Assignee: Canon Kabushiki Kaisha, Tokyo, Japan

[21] Appl. No.: 865,925

[22] Filed: Dec. 30, 1977

[30] Foreign Application Priority Data

Jan. 14, 1977 [JP] Japan ..... 52-3498

[51] Int. Cl.[2] ..... G03G 15/00

[52] U.S. Cl. ..... 355/3 TR; 355/3 SH

[58] Field of Search ..... 355/3 R, 3 TR, 3 TE, 355/3 SH, 3 CH; 361/229, 230

[56] References Cited

U.S. PATENT DOCUMENTS

| | | | |
|---|---|---|---|
| 2,909,971 | 10/1959 | Barber | 355/6 |
| 3,687,539 | 8/1972 | Furuichi | 355/3 R X |
| 3,745,413 | 7/1973 | Whitmore | 361/229 |
| 3,893,760 | 7/1975 | Thettu | 355/3 TR |
| 3,977,779 | 8/1976 | Brooke | 355/3 TR |
| 4,000,942 | 1/1977 | Ito et al. | 355/3 TR |

FOREIGN PATENT DOCUMENTS

| | | | |
|---|---|---|---|
| 7502441 | 5/1975 | Netherlands | 355/3 CH |

*Primary Examiner*—Fred L. Braun

*Attorney, Agent, or Firm*—Fitzpatrick, Cella, Harper & Scinto

[57] ABSTRACT

An improved image transfer device for intermittently bringing a continuous image transfer medium into contact with the images on an image bearing member and transferring the images from the image bearing member to the image transfer medium. The image transfer device of the present invention utilizes an air pressure to bring the continuous image transfer medium into contact with and separate it from the image bearing member without the transfer medium and the surface of the image bearing member being contacted by a mechanical member such as an image transfer roller or bar or the like.

7 Claims, 6 Drawing Figures

IMAGE TRANSFER DEVICE

BACKGROUND OF THE INVENTION

1. Field of the Invention

This invention relates to an image transfer device in which visualized images resulting from electrostatic latent images formed on an image bearing member being developed with developer are transferred to a continuous image transfer medium.

2. Description of the Prior Art

There is a technique whereby an electrophotographic apparatus for recording images by transferring toner images from an image bearing member to a continuous image transfer medium may be utilized to copy original images or utilized as the high-speed output device of an information process system such as electronic computer. In such technique, continuous paper such as fan-folded paper or rolled paper is commonly used as the continuous image transfer medium because of its ease of manipulation and its stability of conveyance.

In such apparatus, when toner images intermittently formed in dependance of the presence of recorded information are to be transferred to a continuous image transfer medium, it is necessary that the continuous image transfer medium be intermittently conveyed and, during non-transfer, the continuous image transfer medium must be separated from the image bearing member to prevent the transfer medium from being stained due to fog of the images.

Therefore, transfer of developed images to an image transfer medium has heretofore been accomplished by bringing the image transfer medium into contact with the developed images on the image bearing member with the aid of the mechanical action of an image transfer roller or bar or the like, imparting a charge to the transfer medium from the back side thereof, the charge being opposite in polarity to that of the toner forming the developed images, thereby causing the charge to attract the toner from the image bearing member to the surface of the image transfer medium. Thereafter, the image transfer medium has been separated from the image bearing member by the aforementioned mechanical action, whereafter the toner image transferred to the image transfer medium has been melted and fixed as by heating or pressure.

Heretofore, such contact with the transfer position and separation into the non-transfer position of the image transfer medium has been carried out mechanically by an image transfer roller or bar or the like, but the use of such mechanical means has encountered difficulties in adjustment of the distance between the image transfer roller or bar and the image bearing member and, in extreme cases, has injured the surface of the image bearing member or imparted unreasonable force to the continuous image transfer medium, thus having damaged such transfer medium. In addition, dust or like material on the continuous image transfer medium has sometimes been deposited on the image transfer roller or the like to hamper uniform image transfer or to cause other inconveniences.

SUMMARY OF THE INVENTION

It is an object of the present invention to provide an image transfer device which produces good transferred images.

It is another object of the present invention to provide an image transfer device which enables high-speed intermittent image transfer.

The present invention which achieves these objects utilizes air pressure to bring a continuous image transfer medium into contact with an image bearing member and separate the former from the latter but without the continuous image transfer medium and the surface of the image bearing member being contacted by a mechanical member. Specifically, means for producing the air pressure may be, for example, a portion of an image transfer corona charger, or a pipe nozzle provided at each or one side lengthwise of the image transfer corona charger. As a further alternative, said means may be provided by a combination of the image transfer corona charger and the pipe nozzle provided at each or one side thereof.

The term "image bearing member" used herein includes an insulating drum, a photosensitive drum, electrostatic recording paper or the like. The image transfer medium may be fan-folded paper, a rolled paper, a continuous web of fabrics, a continuous film, a continuous web of vinyl or any other material on which recording may be effected.

The invention will become more fully apparent from the following detailed description of some embodiments thereof taken in conjunction with the accompanying drawings.

DESCRIPTION OF THE PREFERRED EMBODIMENTS

Figures 1, 4:
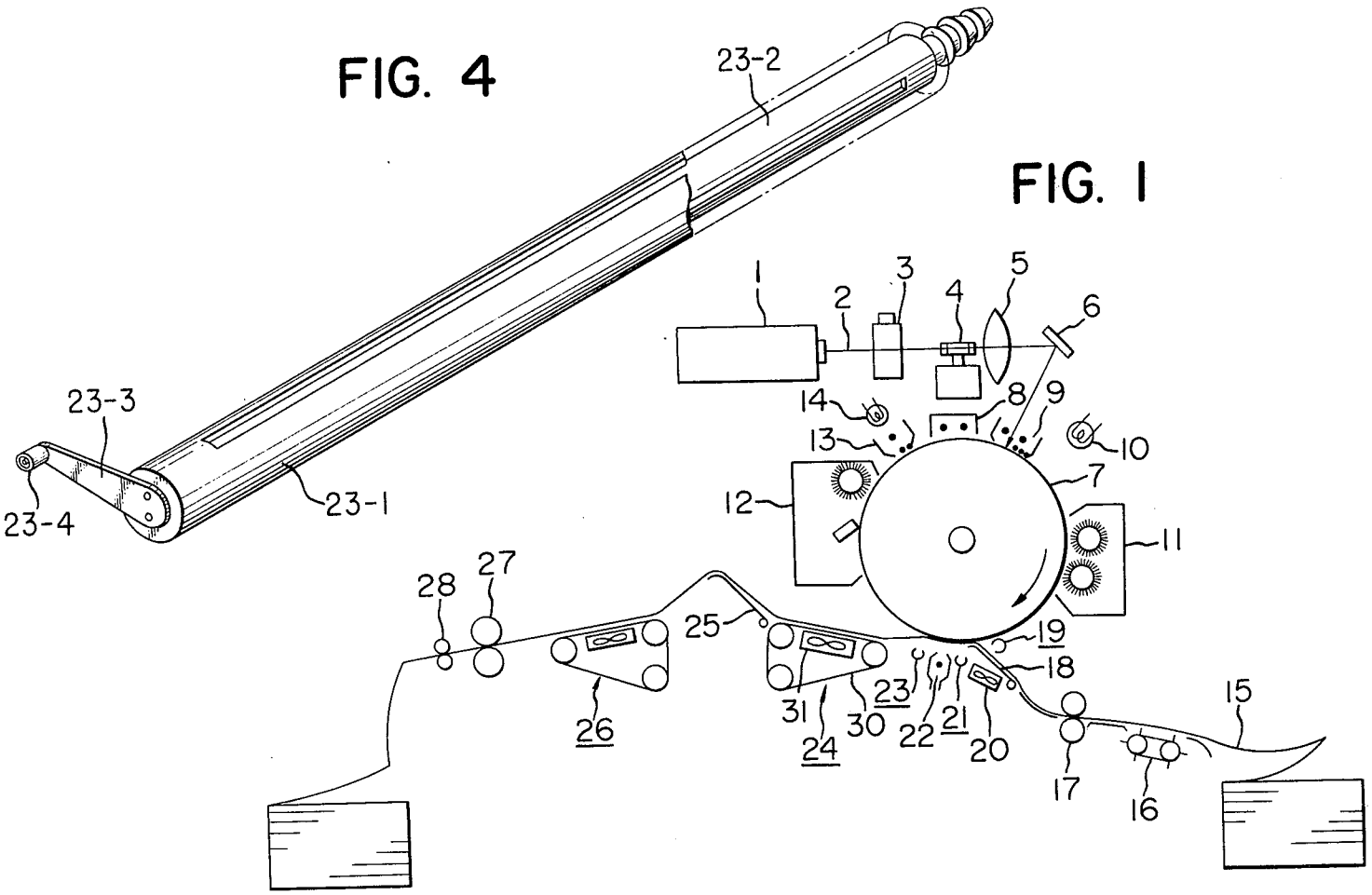
FIG. 1 is a cross-sectional view of an apparatus to which the present invention is applied.
FIG. 4 is a perspective view of a pipe nozzle.
Figure 2:
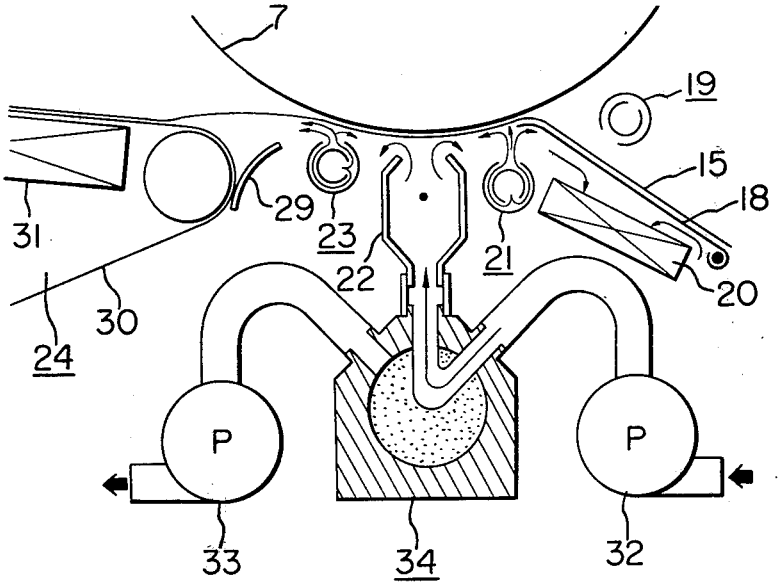
FIG. 2 is an enlarged cross-sectional view of the image transfer device according to the present invention.

Referring to FIG. 1 which is a cross-sectional view of an apparatus in which the present invention is incorporated, a laser beam 2 oscillated by a laser oscillator 1 is modulated in accordance with an input signal to a modulator 3, whereafter it is scanned by a rotating polygonal mirror 4 so as to be projected on a drum-shaped photosensitive medium 7 rotating in the direction of arrow. Of course, the projection of image light may also be accomplished by using a cathode ray tube, plasma display means or the like. In the present embodiment, one of various electrophotographic processes already proposed is applicable and as an example, the use of the process disclosed in our Japanese Patent Publication No. 23910/1967 (corresponding to U.S. Pat. No. 3,666,363) will hereinafter be described. The photosensitive medium 7, which basically comprises an electrically conductive back-up member, a photoconductive layer and a surface insulating layer, is uniformly precharged by a primary corona charger 8. Subsequently, the photosensitive medium 7 is subjected to the aforementioned projection of image light and at the same time, AC corona discharge by an AC corona discharger 9, and then the whole surface of the photosensitive medium is uniformly illuminated by a whole surface exposure lamp 10, whereby an electrostatic latent image corresponding to the image light is formed on the surface of the photosensitive medium. This electrostatic latent image is developed by a well-known developing device 11. The image so developed is transferred to fan-folded paper 15, conveyed by a tractor 16, conveyor rollers 17 and a first intermediate conveyor device 24, by the utilization of an electric field provided by an image transfer corona charger 22. FIG. 2 is an enlarged cross-sectional view of portions of the image transfer device according to the present invention. During image transfer, compressed air is supplied to an image corona charger 22 by an air pump 32 through an air stream direction selecting valve 34, in the manner as shown. By the air stream so injected from the corona charger, the fan-folded paper is generally brought into good contact with the image bearing medium, thereby enabling uniform charging and provision of a good transferred image. Further to enhance the contact effect, compressed air may also be supplied from an outside source (not shown) into pipe nozzles 21 and 23 provided at the opposite sides of the corona charger 22, thereby bringing the fan-folded paper 15 into better contact with the photosensitive medium 7. In this case, the pipe nozzles provided at the opposite sides of the corona charger 22 increase the range of contact of the fan-folded paper 15 with the photosensitive medium 7, thus further enhancing the contact effect. On the other hand, the fan-folded paper 15 is guided so as to make smooth contact with the photosensitive medium 7 by being prevented from unnecessarily vibrating by an apertured guide plate 18 and a suction fan 20 at the entrance to the image transfer station. Subsequently, the dry fan-folded paper 15 is subjected to transfer of the aforementioned developed image, whereafter the paper 15 is conveyed with the aid of the sliding friction between the paper and a first apertured intermediate conveyor belt 30 caused by a first intermediate conveyance-suction fan 31. Thereafter, as shown in FIG. 1, the fan-folded paper passes through a buffering plate 25, a second intermediate conveyor device 26 and a fixing device 27, and is then discharged outwardly of the machine by a set of discharge rollers 28. In the present embodiment, the injection of the air stream from the corona charger 22 is not always necessary but the other air stream producing means such as pipe nozzles 21 and 23 may be provided independently.

Figure 3:
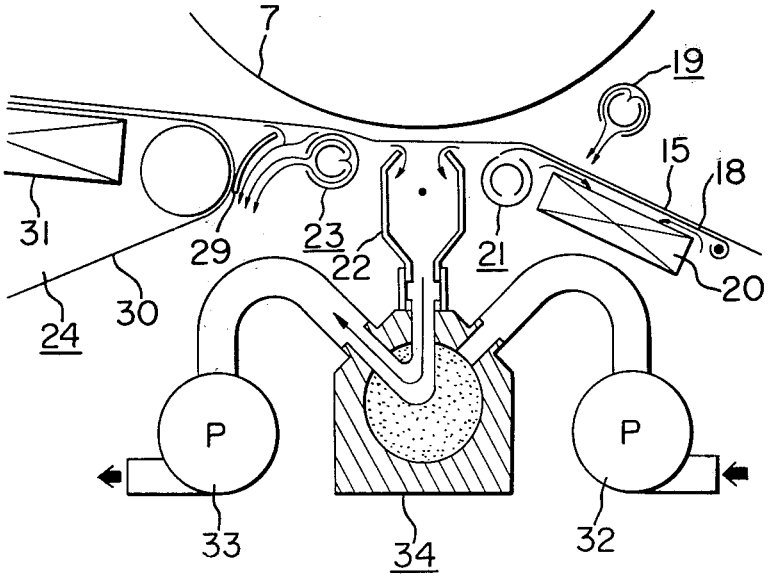
FIG. 3 is a cross-sectional view of the image transfer device during non-transfer.

FIG. 3 illustrates the condition of the image transfer station when no image transfer is occurring between the fan-folded paper and the photosensitive medium. The air in the image transfer corona charger 22 is taken into a pump 33 by the air stream direction selecting valve 34 changing over to the suction pump 33 side. Thus, the air stream is introduced into the pump 33 through the opening of the charger 22 to thereby permit the fan-folded paper 15 to be quickly separated from the photosensitive medium 7. At the same time, the blast to the pipe nozzle 21 is stopped and the pipe nozzle 23 changes its opening position to a lateral direction, thus permitting the air stream to flow along the guide plate 29. The air stream so flowing along the guide plate 29 in turn produces a downwardly directed air stream, by which the fan-folded paper 15 is downwardly drawn and separated from the photosensitive medium 7 by the first intermediate conveyor device 24. Also, at the entrance to the image transfer station, the apertured guide plate 18 is lowered by the attraction of a plunger or the like (not shown) and the separation of the fan-folded paper 15 is also aided by the air stream from the suction fan 20 and from the separating pipe nozzle 19, whereby the separation of the paper is accomplished reliably. Thus, in the present embodiment, the separation of the fan-folded paper is aided by the air streams not only from the charger 22 and pipe nozzles 21, 23 but also from the separating pipe nozzle 19 and the lowering of the apertured guide plate 18 as well as the action of the suction fan, so that the separation can instantaneously take place to ensure very good image transfer without the image being injured. In addition, the separation of the fan-folded paper 15 from the photosensitive medium 7 may be achieved with high reliability. Alternatively, the pipe nozzles 21 and 23 may be designed to assume the air-suction mode at the time of separation, or the pipe nozzle 21 may be designed to change the direction of its opening position as in the pipe nozzle 23. In the present invention, the separation of the fan-folded paper 15 is shown as being accomplished by a combination of various means, whereas it is of course possible that the separation of the fan-folded paper 15 may be achieved solely by the air stream injected from the charger 22.

Figure 5:
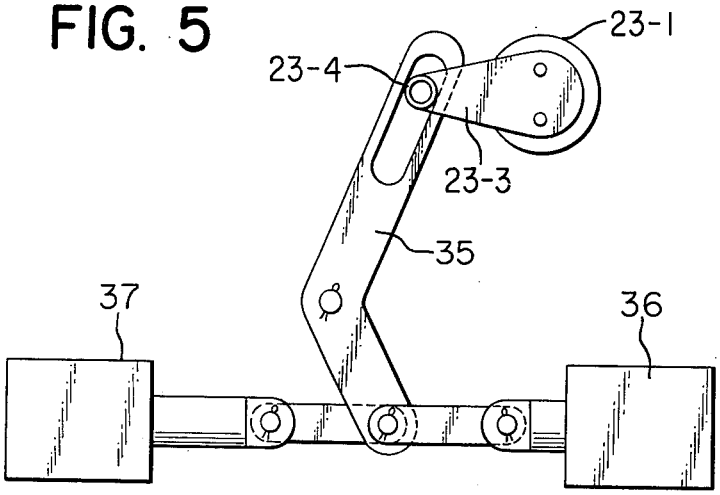
FIG. 5 illustrates a mechanism for changing over the opening of the pipe nozzle.

FIG. 4 shows the construction of the pipe nozzle 23. The pipe nozzle 23 comprises an inner pipe 23-2 having a slit extending axially of a concentric cylinder, and an outer pipe 23-1 which is a concentric cylinder surrounding the inner pipe and having a slit similar to that of the inner pipe. By supplying compressed air into the inner pipe 23-2 from outside, there may be produced an air stream flowing out through the outer pipe 23-1. With such a construction, the air pressure injected through the slit of the outer pipe 23-1 may be uniformized throughout the entire slit area. Pipe nozzles 19 and 21 are functionally similar to the pipe nozzle 23. The air stream outlet need not always be a continuous slit and may be, for example, elliptical openings. Further, as shown in FIG. 5, a lever 23-3 attached to the outer pipe 23-1 effects movement corresponding to the movement of an arm 35 through the agency of a roller 23-4, so that the opening of the outer slit 23-1 may be varied by energization of a plunger 36 or 37.

Figure 6:
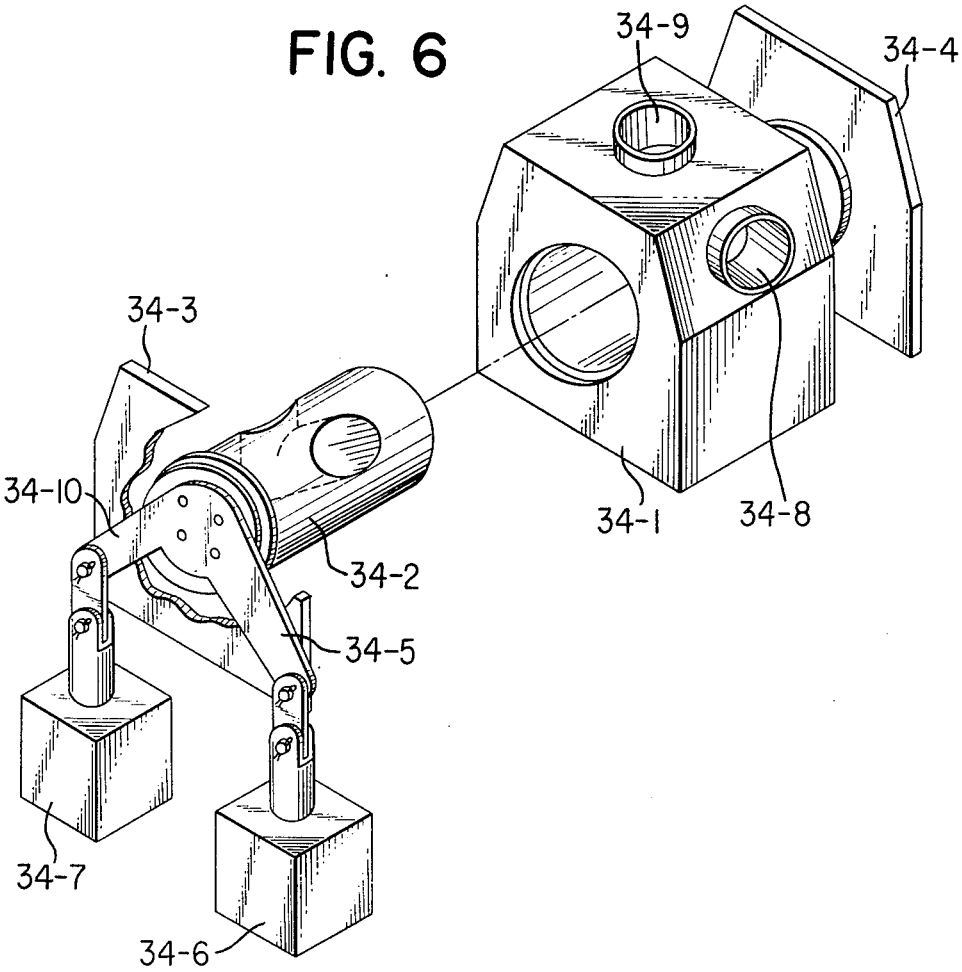
FIG. 6 is a perspective view of an air stream direction selecting valve.

Description will now be made of the air stream direction selecting valve 34 shown in FIG. 6. The air stream selecting valve 34 comprises a rotary valve 34-2 in which two differently directed openings of a stationary valve 34-1 having three openings (of which 34-8 and 34-9 are only shown, excepting the other one) connected to the blower pump 32, the image transfer corona charger 22 and the suction pump 33, respectively, and side covers 34-3 and 34-4 for enclosing and sealing the rotary valve 34-2 in the stationary valve 34-1. Arms 34-5 and 34-10 attached to one end of the rotary valve 34-2 is operable, upon energization of a plunger 34-6 or 34-7, to select the direction of the air stream. One of the arms 34-5 and 34-10 may be replaced by a spring. In this case, only one plunger is required. With such a simple construction as described above, the direction of the air stream may be changed instantaneously and easily. The image bearing member is not restricted to the aforementioned photosensitive medium, but may be an insulating drum, electrostatic recording paper or the like.

According to the present invention, as has hitherto been described in detail, compressed air may be injected through the opening of each pipe nozzle or of the image transfer corona charger to bring the entire surface of the transfer medium into contact with the image bearing member. Or, when the transfer medium is to be separated from the image bearing member, the separation may be instantaneously accomplished not only by the stoppage of the injection from the aforementioned mechanism and change of the direction of injection but also by the downward displacement of the guide plate and the action of the mechanisms such as the suction fan, separating pipe nozzles, etc., whereby good image transfer may be accomplished. Moreover, where the pressure contact with and the separation from the image bearing member of the transfer medium is easily accomplished, one or more of the constructions shown in the described embodiment may be selected and disposed. Also, the contact with and the separation from the image bearing member of the continuous transfer medium is effected by the use of air pressure but without the continuous transfer medium being contacted by another member, thus eliminating the problem of attempting to adjust the distance as was done in the prior art and also eliminating the risk of the surface of the photosensitive medium and/or the transfer medium being injured or having a deposition of dust thereon which would result if the transfer medium was contacted by another member. When the transfer medium used was narrower in width than the photosensitive medium, the photosensitive medium was directly contacted by an image transfer roller and injured or stained by the surface of the photosensitive medium, whereas the present invention eliminates such image transfer roller and therefore its contact with the photosensitive medium, thus accomplishing good image transfer. In this case, there would be a fear that any excess developer deposited on the surface of the photosensitive medium might be scattered by the air stream, but the strong force with which the developer adheres to the photosensitive medium prevents such an occurence. Further, the device of the present invention is much quicker in response than the mechanical action of an image transfer roller or bar or the like, thus enabling rapid image transfer.

What we claim is:

1. An image transfer device having a transfer station where a continuous transfer material is brought into contact with an image formed on an image bearing member, and the image is transferred onto a transfer material, said device comprising:

means for feeding and guiding the continuous transfer material to the transfer station;

means for transferring the image from the image bearing member onto the transfer material;

air flow means for controlling a flow of air to and from said transfer means to force the transfer material into contact with the image bearing member during image transfer, and to separate and remove the transfer material from contact with the image bearing member; and means for guiding and transporting the continuous transfer material away from the transfer station.

2. A device according to claim 1, wherein, said transferring means includes a corona discharger.

3. An image transfer device having a transfer station where a continuous transfer material is brought into contact with an image formed on an image bearing member, and the image is transferred onto the transfer material, said device comprising:

means for feeding and guiding the continuous transfer material to the transfer station;

means for transferring the image from the image bearing member onto the transfer material;

air flow means for bringing said transfer material in contact with said image bearing member for effecting image transfer, and for subsequently separating and removing said material from said member, said air flow means being disposed at the transfer station for blowing air to the transfer material, during transfer of the image, to bring the transfer material into contact with the image bearing member, and for sucking air upon completion of said transfer to remove the transfer material from contact with the image bearing member; and means for guiding and transporting the continuous transfer material away from the transfer station.

4. A device according to claim 3, wherein said air flow means includes a pipe nozzle.

5. A device according to claim 3, wherein said feeding and guiding means includes a guiding plate having an opening and a suction fan disposed under said guiding plate.

6. A device according to claim 3, wherein said air flow means includes an inner pipe having a longitudinal opening, and an external pipe having a longitudinal opening, said external pipe being concentric with and spaced from the inner pipe.

7. A device according to claim 6, wherein, one of said pipes is rotatable with respect to the other, and wherein the air flow is changed in its direction by rotating the external pipe with respect to said inner pipe.

* * * * *